US005349168A

United States Patent [19]

Wilen

[11] Patent Number: 5,349,168

[45] Date of Patent: Sep. 20, 1994

[54] MICROWAVEABLE PACKAGING COMPOSITION

[75] Inventor: Allan S. Wilen, Kernersville, N.C.

[73] Assignee: Zeneca Inc., Wilmington, Del.

[21] Appl. No.: 101,807

[22] Filed: Aug. 3, 1993

Related U.S. Application Data

[63] Continuation of Ser. No. 545,330, Jun. 27, 1990, abandoned.

[51] Int. Cl.[5] ..... H05B 6/80

[52] U.S. Cl. ..... 219/730; 219/731; 99/DIG. 14; 426/107; 426/113; 426/234; 426/243; 427/407.1; 428/323

[58] Field of Search ..... 219/730, 731, 10.55 E, 219/10.55 F; 99/DIG. 14; 426/107, 113, 234, 243; 427/407.1; 428/323, 328, 461; 206/484

[56] References Cited

U.S. PATENT DOCUMENTS

| | | | |
|---|---|---|---|
| 3,853,612 | 12/1974 | Spanoudis | 117/212 |
| 3,922,452 | 11/1975 | Forker, Jr. et al. | 428/35 |
| 4,190,757 | 2/1980 | Turpin et al. | 219/10.55 E |
| 4,264,668 | 4/1981 | Balla | 428/195 |
| 4,267,420 | 5/1981 | Brastad | 219/10.55 E |
| 4,434,197 | 2/1984 | Petriello et al. | 427/407.1 |
| 4,518,651 | 5/1985 | Wolfe | 428/308.8 |
| 4,735,513 | 4/1988 | Watkins et al. | 383/116 |
| 4,765,929 | 8/1988 | Shaffer | 252/511 |
| 4,808,780 | 2/1989 | Seaborne | 219/10.55 E |
| 4,825,024 | 4/1989 | Seaborne | 219/10.55 E |
| 4,864,089 | 9/1989 | Tighe et al. | 219/10.55 E |
| 4,866,232 | 9/1989 | Stone | 219/10.55 E |
| 4,876,423 | 10/1989 | Tighe et al. | 219/10.55 E |
| 4,878,765 | 11/1989 | Watkins et al. | 383/116 |
| 4,892,782 | 1/1990 | Fisher et al. | 428/240 |
| 4,904,836 | 2/1990 | Turpin et al. | 219/10.55 E |
| 4,914,266 | 4/1990 | Parks et al. | 219/10.55 E |
| 4,927,991 | 5/1990 | Wendt et al. | 219/10.55 E |
| 4,933,526 | 6/1990 | Fisher et al. | 219/10.55 M |
| 4,935,252 | 6/1990 | Huang et al. | 426/107 |
| 4,937,173 | 6/1990 | Kanda et al. | 430/281 |
| 4,943,456 | 7/1990 | Pollart et al. | 428/34.3 |
| 4,959,516 | 9/1990 | Tighe et al. | 219/10.55 F |
| 4,962,000 | 10/1990 | Emslander et al. | 219/10.55 E |
| 4,970,358 | 11/1990 | Brandberg et al. | 219/10.55 |
| 4,970,360 | 11/1990 | Pesheck et al. | 219/10.55 E |
| 4,972,058 | 11/1990 | Benson et al. | 219/10.55 E |
| 5,002,826 | 3/1991 | Pollart | 428/323 |
| 5,006,405 | 4/1991 | Watkins et al. | 428/323 |
| 5,021,293 | 6/1991 | Huang et al. | 428/328 |
| 5,038,009 | 8/1991 | Babbitt | 219/10.55 E |
| 5,041,295 | 8/1991 | Perry et al. | 426/107 |
| 5,059,279 | 10/1991 | Wilson | 156/651 |
| 5,079,083 | 1/1992 | Watkins et al. | 428/323 |
| 5,079,397 | 1/1992 | Keefer | 219/10.55 E |
| 5,095,186 | 3/1992 | Russell et al. | 219/10.55 E |
| 5,118,747 | 6/1992 | Pollart et al. | 524/424 |
| 5,132,144 | 7/1992 | Parks | 427/210 |
| 5,149,396 | 9/1992 | Wilson | 156/656 |
| 5,164,562 | 11/1992 | Huffman et al. | 219/10.55 E |
| 5,171,594 | 12/1992 | Babbitt | 426/107 |
| 5,175,031 | 12/1992 | Ochocki | 428/34.2 |
| 5,177,332 | 1/1993 | Fong | 219/10.55 E |
| 5,180,894 | 1/1993 | Quick et al. | 219/10.55 E |
| 5,183,787 | 2/1993 | Seaborne | 501/143 |
| 5,185,506 | 2/1993 | Walters | 219/10.55 E |
| 5,195,829 | 3/1993 | Watkins et al. | 383/100 |

FOREIGN PATENT DOCUMENTS

| | | | |
|---|---|---|---|
| 242952 | 10/1987 | European Pat. Off. . | |
| 0357008 | 8/1989 | European Pat. Off. | C09D 5/38 |

*Primary Examiner*—Bruce A. Reynolds
*Assistant Examiner*—Tu Hoang

[57] ABSTRACT

Microwaveable packing compositions exhibiting improved temperature control are provided. These compositions comprise a dielectric substrate having at least a portion of at least one of its surfaces coated with a matrix composition containing susceptor particles as well as particles of a blocking agent selected from the group consisting of calcium salts, zinc salts, zinc oxide, lithopone, silica and titanium dioxide. Also disclosed is a microwaveable ink composition useful for the preparation of such packaging compositions as well as a process for manufacturing such packaging compositions.

25 Claims, No Drawings

MICROWAVEABLE PACKAGING COMPOSITION

This is a continuation of copending application Ser. No. 07/545,330 filed on Jun. 27, 1990, now abandoned.

FIELD OF THE INVENTION

In one aspect, this invention is directed to a microwaveable package comprising a dielectric substrate substantially transparent to microwave radiation having at least one portion of at least one surface thereof coated with a coating composition comprising a dielectric matrix having dispersed therein (A) a sufficient amount of particles of microwave susceptor material such that heat will be generated when such coating composition is exposed to microwave radiation; and (B) a sufficient amount of particles of a blocking agent selected from the group consisting of calcium salts, zinc salts, zinc oxide, lithopone, silica and titanium dioxide, such that when such coating composition is subjected to a preselected dosage of microwave radiation the heat generated by the susceptor material is controlled with a preselected range.

In another aspect, this invention is directed to a microwaveable packaging ink composition comprising a liquid carrier having incorporated therein (A) a dielectric polymeric material substantially transparent to microwave radiation; (B) particles of microwave susceptor material; and (C) particles of at least one blocking agent selected from the group consisting of calcium salts, zinc salts, zinc oxide, lithopone, silica and titanium dioxide; such microwave susceptor material and blocking agent being present in amounts such that when the coating formed by the application of such ink is subjected to a preselected dosage of microwave radiation, the heat generated by the susceptor material is controlled within a preselected range.

In yet another aspect, this invention is directed to a process for manufacturing such a microwaveable packaging composition.

BACKGROUND OF THE INVENTION

The recent proliferation of microwave ovens for the preparation and cooking of food has created a need for the production of improved packaging in order to render certain types of food more amenable to microwave cooking. Thus, for example, certain foods, such as popcorn, may not absorb enough microwave energy to generate sufficient heat to pop or cook. Other foods require browning or crisping of their surfaces, results which cannot ordinarily be achieved by the use of conventional food packaging compositions in microwave ovens.

In order to meet this need for improved microwaveable packing, several different approaches have been proposed.

One general approach has been to form a multi-layered wrap-type composition composed of an energy absorbing susceptor material and a plastic film or other dielectric substrate. Thus, for example, U.S. Pat. No. 4,267,420 (Brastad) discloses a packaging material which is a plastic film or other dielectric substrate having a thin semiconducting coating, preferably of evaporated aluminum. Somewhat similarly, U.S. Pat. No. 4,434,197 (Petriello et al) shows a multi-layered laminated microwaveable packaging material including outside layers of polytetrafluoroethylene, two intermediate layers of pigmented polytetrafluoroethylene and a central layer of polytetrafluoroethylene having dispersed therein particles of an energy absorbing susceptor material such as graphite, ferric oxide or carbon.

A second general approach which has been proposed involves the dispersion of particles of a microwave absorbing composition in a polymeric or ceramic-type material matrix. Thus, for example, U.S. Pat. No. 4,190,757 (Turpin et al) discloses a microwaveable package composed of a non-lossy dielectric sheet material defining a container body and a lossy microwave absorbitive heating body connected thereto, such heating body typically comprising particles of microwave absorbitive susceptor material (including zinc oxide, germanium oxide, iron oxide, alloys of metals such as of manganese, aluminum and copper, oxides, carbon and graphite) in a ceramic-type binder (such as cement, plaster of paris or sodium silicate). Somewhat similarly, U.S. Pat. No. 4,518,651 (Wolfe) shows microwaveable composite materials comprising a polymeric matrix having electronically conductive particles dispersed therein, which matrix is bound to a porous substrate. This patent teaches that it is critical that at least some of the polymer matrix beneath the surface of the substrate be substantially free of electronically conductive particles and be intermingled with the substrate.

European Patent Publication 242,952 discloses a microwaveable packaging material which is a composite comprising a dielectric material (e.g., polyethylene terephthalate film) coated with a mixture of an electrically conductive metal or metal alloy in flake form in a dielectric matrix. This patent indicates that to obtain optimum heating performance reproductibility, circular flakes with flat surfaces and smooth edges should be employed. Somewhat similarly, U.S. Pat. No. 4,866,232 (Stone) discloses a food package for use in a microwave oven, such package being produced by the deposition of a metallized ink consisting of metal particles suspended in an ink-like substance onto a container formed from a heat resistant material which is pervious to microwaves.

While many of the above and similar microwaveable packaging compositions will function to convert microwave energy into heat, there is still a need for improved packaging materials. Thus, many proposed microwaveable packaging materials tend to heat uncontrollably in a microwave oven, leading to charring or even arcing, ignition and burning of the packaging material. Other materials are not capable of generating sufficient heat quickly, while several materials, while functioning desirably, are economically prohibitive for widespread use.

Accordingly, it is an object of this invention to provide a microwaveable package which provides for increased control of the heat generated by exposure to microwaves.

It is a further object of this invention to provide a microwaveable packaging ink composition which when deposited on a dielectric substrate will offer improved control of the heat generated upon exposure to microwave radiation.

It is yet a further object of this invention to provide a microwaveable packaging ink composition which can be economically employed.

It is an additional object of this invention to provide a method of economically producing a microwaveable package which provides increased control of the heat generated upon exposure to microwave radiation.

These objects, and other additional objects, will become more fully apparent from the following description and accompanying Examples.

SUMMARY OF THE INVENTION

In one aspect, this invention is directed to a microwaveable package comprising:

(A) a dielectric substrate substantially transparent to microwave radiation; and (B) a coating on at least a portion of at least one surface of such substrate, said coating comprising a matrix comprised of a dielectric polymeric material having dispersed therein:

(i) a sufficient amount of particles of microwave susceptor material such that heat will be generated when such coating is exposed to microwave radiation; and (ii) a sufficient amount of particles of a blocking agent selected from the group consisting of calcium salts, zinc salts, zinc oxide, lithopone, silica and titanium dioxide such that when such coating is exposed to a preselected dosage of microwave radiation the heat generated by the susceptor material is controlled within a preselected range.

In another aspect, this invention is directed to a microwaveable packaging ink composition comprising a liquid carrier having incorporated therein:

(A) a dielectric polymeric material substantially transparent to microwave radiation;

(B) particles of a microwave susceptor material; and (C) particles of a blocking agent selected from the group consisting of calcium salts, zinc salts, zinc oxide, lithopone, silica and titanium dioxide;

such microwave susceptor and blocking agent being present in amounts such that when the coating formed by the application of such ink is subjected to a preselected dosage of microwave radiation, the heat generated by the coating is controlled within a preselected range.

In yet another aspect, this invention is directed to a process of manufacturing a microwaveable package comprising the steps of:

(A) preparing a coating composition comprising:

(i) a dielectric polymeric material;

(ii) particles of microwave susceptor material; and (iii) particles of a blocking agents selected from the group consisting of calcium salts, zinc salts, zinc oxide, lithopone, silica and titanium dioxide;

such microwave susceptor material and blocking agent material being present in amounts such that when a coating formed by the application of such coating composition is subjected to a preselected dosage of microwave radiation, the heat generated by the susceptor material is controlled within a preselected range; and (B) coating such composition onto at least a portion of at least one surface of a dielectric substrate substantially transparent to microwave radiation.

DETAILED DESCRIPTION OF THE PREFERRED EMBODIMENTS

The microwaveable package of this invention is comprised of a dielectric substrate substantially transparent to microwave radiation having at least a portion of at least one surface thereof coated with a coating composition comprising a dielectric polymeric matrix having incorporated therein (A) particles of a microwave susceptor material; and (B) particles of a blocking agent.

In general, the dielectric substrate may be any material having sufficient thermal and dimensional stability to be useful as a packaging material at the high temperatures which may be desired for browning or rapidly heating foods in a microwave oven (e.g., as high as 150° C. and above). Useful substrates include polymeric films, for example, polyester films such as polyethylene terephthalate films as well as polymethylpentene films, and films of other thermally stable polymers such as polyarylates, polyamides, polycarbonates, polyetherimides, polyimides and the like. Moreover, porous structures such as paper or non-woven materials can also be employed as substrates so long as the required thermal and dimensional stability is satisfied. For flexible packaging, the substrate is preferably about 8 to 50 micrometers thick. Thicker, non-flexible materials, such as found in trays, lidding, bowls and the like, may also be employed.

As previously indicated, the substrate must have sufficient dimensional stability at the elevated temperatures involved in microwave cooking to prevent distortion of the substrate which may result in non-uniform cooking from loss of intimate contact of the packaging material with the food to be cooked. Substrates normally lacking such high temperature dimensional stability can be used if they are laminated with yet another substrate layer meeting the thermal stability requirements of the original substrate. The lamination can be accomplished either by taking advantage of the adhesive properties of the thermoplastic matrix coating on the original substrate or by using any number of conventional adhesives to aid in forming a stable laminate. For example, a polyester copolymer coated polyethylene terephthalate film can be thermally sealed to another polyester film or to paper or heavier ovenable paperboard. Alternatively, another adhesive can be applied from solution prior to lamination to increase the strength of the laminate. These supplemental adhesives can be selected from a number of commercially available candidates with required thermal stability. These include copolyesters, copolyester-polyurethanes and cyanoacrylates.

The dielectric polymeric material forming the matrix of the coating composition formed in the practice of this invention may be composed of a variety of materials which, when deposited onto a suitable substrate, exhibit sufficient thermal stability to allow for dimensional integrity of the final packaging material at the elevated temperatures associated with microwave cooking of food.

The dielectrical properties at 915 megahertz and 2450 megahertz of the matrix formed by the deposition of the polymeric material upon the packaging substrate is an important variable in terms of the heat generated in unit time at 2450 MHz. Specifically, the dielectric matrix should, in general, possess a relative dielectric constant of between about 2.0 and about 10, preferably of between about 2.1 and about 5, and should generally possess a relative dielectric loss index of between about 0.001 and about 2.5, preferably of between about 0.01 to 0.6. The matrix also preferably displays adhesive characteristics to the substrate as well as to any additional substrate to which the composite may be laminated to increase dimensional stability.

Illustrative of suitable matrix materials are polyacrylates, polymethacrylates, polyesters, polyester copolymers, curable resins such as copolyester-polyurethanes and epoxy resins, polycarbonates, polyethersulfones, polyarylsulfones, polyamide-imides, polyimides, polyetheretherketones, poly-4'4-isopropylidene diphenylene carbonate, imidazoles, oxazoles, and thiazoles. These materials may be crystalline or amorphous.

Preferred matrix materials include acrylic polymers and copolymers such as polymethacrylates, polyacrylates, styrene-acrylate copolymers, and styrene-methacrylate copolymers. Particularly preferred polymeric materials are poly(methyl methacrylate) and poly(ethyl methacrylate) having a molecular weight of between about 1,500 and about 20,000.

The microwave susceptor materials employed in the practice of this invention include any materials which are capable of absorbing the electric or magnetic portion of the microwave field energy and converting that energy into heat. Suitable materials include metals such as powdered nickel, antimony, copper, molybdenum, bronze, iron, chromium, tin, zinc, silver, gold and aluminum. Other conductive materials such as graphite and semi-conductive materials such as silicon carbides and magnetic material such as metal oxides (if available in particulate form) may also be employed as susceptor materials. Ground metallized films may also be utilized. Particularly preferred susceptor materials include alloys of copper, zinc and nickel sold under the designation SF-401 by Obron; as well as leafing aluminum powder.

The susceptor materials employed in the practice of this invention are in particulate form. Such particles may be flakes or powders. The size of such particles will vary in accordance with a number of factors, including the particular susceptor material selected, the amount of heat to be generated, the manner in which the coating composition is to be applied; and the like.

Typically, however, when such coating compositions are to be applied in the form of inks, due to limitations of the printing processes such powders will have diameters of no more than about 50 microns. In general, in such circumstances, particle sizes of between about 0.1 and about 25 microns are preferably employed. When the susceptor materials are employed in the form of flakes, (e.g., such as in the form of leafing aluminum) such flakes are typically of those sizes of flakes routinely used in the gravure ink art for the printing of metallic coatings.

The blocking agent employed in the practice of this invention comprises at least one member of the group consisting of calcium salts, zinc salts, zinc oxide, lithopone, silica and titanium dioixde. Preferred blocking agents include calcium carbonate, calcium sulfate, zinc oxide, silica and titanium dioxide and calcium carbonate, with calcium carbonate being most preferred.

The blocking agents employed in the practice of this invention are typically employed in particulate form. The particle size of such blocking agents is generally limited by the particular coating process employed, and when such coating is applied in the form of an ink, such particle size is typically less than about 50 microns, with particle sizes of between about 0.1 and about 25 microns being preferred for most blocking agents. When calcium carbonate is employed as the blocking agent, particle sizes of between about 1 and about 10 microns are more preferred, with particle sizes of between about 3 and about 7 microns being most preferred.

While not wishing to be held to any particular theory, applicant has found that the presence of such blocking agent controls the amount of heat generated by the susceptor material. By controlling the ratio and amount of blocking agent and susceptor, and/or by varying the thickness of the ink applied, the amount of heat generated by a preselected dosage of microwave radiation may be consistently controlled within a preselected range.

Variables which must be taken into account for determining the precise ratios of susceptor to blocking agent needed for any particular use include the physical size, shape and surface characteristics of the susceptor and blocking agent particles contained in the coating composition, the amount of coating composition to be applied to the substrate, and the portion size as well as the food to be cooked in such application. By so altering these variables as well as the susceptor:blocking agent ratio employed, one of ordinary skill can easily regulate the compositions of this invention to heat to high temperatures in a controlled manner in relatively short periods of time in conventional microwave ovens, e.g., to temperatures of about 150° C. or above, preferably 190° C. or above in 120 seconds when subjected to microwave energy generated in dosages typically produced by such ovens, e.g. at 550 watts at 2450 megahertz.

The susceptor level in the matrix will generally range from about 3 to about 80% by weight of the combined susceptor blocking agent/matrix composition. As noted above the optimum levels of susceptor material and of blocking agent incorporated into the coating compositions of this invention will depend upon a number of factors, depending upon the ultimate end use employed. However, it has been found that, in many instances, weight ratio of 1:4 or more of blocking agent:susceptor material will effectively prevent heating of the coating composition when subjected to dosages of microwave radiation generated by conventional microwave ovens. Lower ratios of blocking agent to receptor material will result in higher temperatures.

One of ordinary skill in the art can easily determine optimum ratios for any particular application using routine experimentation, such as that described in the Examples hereto, wherein the calories generated by a particular dosage of microwave radiation are measured for particular coating compositions of given thickness.

The polymeric material is present in an amount sufficient to form a matrix for the blocking agent and susceptor material.

In addition to the blocking agent, polymeric material, liquid carrier and susceptor material the coating composition employed in the microwaveable package of this invention may optionally contain other conventional additives such as surface modifiers such as waxes and silicones, antifoam agents leveling agents, surfactants, colorants such as dyes and pigments and the like, which additives are well known to those of ordinary skill in the art.

The microwaveable packaging ink composition of this invention is comprised of a liquid carrier having dispersed or dissolved therein (A) a matrix-forming dielectric polymeric material substantially transparent to microwave radiation; (B) particles of a susceptor material; and (C) particles of a blocking agent.

The liquid carriers which may be employed include those organic solvents conventionally employed in the manufacture of ink as well as water and mixtures of one or more of the foregoing. Illustrative of such solvents are liquid acetates such as isopropyl acetate and the like;

alcohols such as isopropanol, butanol and the like; ketones such as methyl ethyl ketone and the like; and aromatic hydrocarbons such as toluene and the like. Particularly preferred solvents include water, isopropyl acetate and mixtures of isopropyl acetate with toluene.

When the ink composition of this invention comprises an aqueous carrier, such composition typically further comprises one or more surfactant and/or dispersant. Thus, desirable results have been obtained employing a combination of an ethoxylated nonyphenol such as Tergitol NP-40, available from Union Carbide; a disperant such as Disperbyk 182 available from Byk Chemie; a wetting agent and antifoaming agent such as Surfynol 104 A. from Air Products; and a protective colloid such as Anti-Terra 207 available from Byk Chemie. In addition, it may often be desirable to add a defoaming agent such as No Foam available from Shamrock. The amounts of each of such component which may be readily determined by one of the ordinary skill in the art employing routine experimentation.

The packaging composition of this invention can be manufactured by a number of methods. In one method, the dielectric matrix may be dissolved or dispersed in any number of common organic solvents such as tetrahydrofuran, methylene chloride, ethyl acetate, methyl ethyl ketone or similar solvents, and then the susceptor and blocking agent dispersed in water or in this solution. Such solution is then applied to the substrate by any number of coating processes such as metered doctor roll coating, gravure coating, reverse roll coating or slot die coating. The liquid is driven off after application of the coating by conventional oven drying techniques to form the final coating composition.

A second technique which may be employed is useful when melt stable matrices are employed. The matrix material is melted in conventional equipment and the susceptor particles blended with the melt. This mixture may then be extrusion or melt coated on the substrate.

The susceptor/blocking agent/matrix may be applied to the substrate in patterns that would allow a variety of temperature properties in a single sheet of composite material. These patterns may comprise coating compositions having varying susceptor to blocking agent ratios or may comprise coating compositions of various thicknesses or both.

The microwaveable compositions of this invention may be economically manufactured such that they are commercially acceptable for mass production. Moreover, such compositions will provide enhanced control of the temperature produced in the microwave oven.

EXAMPLES

The following Examples are intended to further illustrate the invention and are not intended to limit the scope of the invention in any manner whatsoever.

Examples 1 and 2 and Comparative Experiment A

In order to show the degree of control provided by the inclusion of a blocking agent, two ink compositions were prepared by combining the following components in a blender:

| Composition | Ex. 1 | Ex. 2 | Comp. Exp. A |
|---|---|---|---|
| Isopropyl Acetate | 16.8 | 25.2 | 33.6 |
| Toluene | 4.2 | 6.3 | 8.4 |
| Poly(butyl methacrylate) | 9.0 | 13.5 | 18.0 |

-continued

| Composition | Ex. 1 | Ex. 2 | Comp. Exp. A |
|---|---|---|---|
| (Neocryl #873, ICI Americas Inc.) | | | |
| Susceptor Material (SF-401, an alloy of copper, nickel and zinc, Obran) | 40.0 | 40.0 | 40.0 |
| Titanium Dioxide (R900, duPont) | 30.0 | 15.0 | -0- |

These compositions were applied to the reverse side of carton stock employing a gravure press using a #6 Meyer bar. These samples were placed coated-side down in a Samruns 450 Watt Microwave over at high setting. The sample produced from the formulation of Comparative Experiment A ignited in less than 5 seconds whereas those samples produced from the formulations of Examples 1 and 2 showed darking on their face side after 60 seconds of exposure, indicating that high heat had been generated without ignition.

Example 3 and Comparative Experiment B

Employing a mixer, two ink compositions were prepared comprising the following parts by weight of the below-listed materials:

| Composition | Ex. 3 | Comparative Exp. B |
|---|---|---|
| Isopropyl Acetate | 36.8 | 38.8 |
| poly(methyl methacrylate) (SCX-611, S. C. Johnson) | 15.8 | 16.6 |
| Aluminum leafing powder (XI-1136, Alcon) | 42.3 | 44.6 |
| Calcium Carbonate (Camelwite) | 5.1 | -0- |

A piece of carton stock was coated with the compositions of Example 3 on one portion and with the composition of Comparative Experiment A on an adjacent portion making a double bump bar down using a number ten Meyer bar. The stock was cut into 3 inch×3 inch squares, with one-half such squares being coated with the blocking agent containing formulation of Example 3 and the other half being coated with the formulation of Comparative Experiment B. A slice of thin white bread was placed between two such samples with the printed side away from the bread and the coatings aligned such that each half of the slice was sandwiched between identical formulations. This configuration was covered by paper towels and placed in a Cober Test Oven (Model LBM1.2A) at 45 seconds with the turntable on and the stirrer running. It was found that under these conditions that that section of the bread which was sandwiched between the coatings of Example 3 had not turned color whereas that section of the bread which was between the coatings of Comparative Experiment B had darkened considerably.

Examples 4–7 and Comparative Experiment C

In order to show the efficacy of several other materials as blocking agent, several additional formulations were prepared as follows using a blender:

| Example | 4 | 5 | 6 | 7 |
|---|---|---|---|---|
| Isopropyl Acetate | 19.61 | 19.61 | 19.61 | 19.61 |
| Isopropyl Alcohol | 4.90 | 4.90 | 4.90 | -0- |
| Toluene | -0- | -0- | -0- | -0- |
| Poly(methyl methacrylate) | 10.49 | 10.49 | 10.49 | 10.49 |

-continued

| Example | 4 | 5 | 6 | 7 |
|---|---|---|---|---|
| (Neocryl #B735, ICIAm Inc.) | | | | |
| Microwave susceptor (SF-40), a copper/zinc/nickel alloy available from Obron | 50.00 | 50.00 | 50.00 | 50.00 |
| Lithopone (stoichiometric mixture of Zn sulfide and Ba Sulfate) | 15.00 | -0- | -0- | -0- |
| Sachtolith (mixture of Zn sulfate and Zn oxide) | -0- | 15.00 | -0- | -0- |
| Calcium Carbonate (Camelwite) | -0- | -0- | 15.00 | -0- |
| Fumed Silica (Syloid #G20, WRGrace) | -0- | -0- | -0- | 15.00 |

Samples of carton stock were printed on their reverse side using a Number 6 Meyer Bar. The samples were then cut into 3 inch squares.

In order to test the effectiveness of the blocking agents in controlling the temperatures generated, a sample square was placed with the printed side down under a 250 ml beaker containing 50 grams of water which had an initial temperature of 68° F. in a Cober Test Oven. The oven was run at 600 watts for 30 seconds with the turntable on, the stirrer on and the vent open. The amount of heat generated was calculated by measuring the increase in temperature of the water. As a control, 50 grams of water alone was heated in this manner. The average of five runs of each Example is summarized below:

| Example or Comparative Experiment | Blocking Agent | Calories Absorbed |
|---|---|---|
| C | None (water only) | 3950 |
| 4 | $ZnS/BaSO_4$ | 3600 |
| 5 | $ZnSO_4/ZnO$ | 3500 |
| 6 | $CaCO_3$ | 3500 |
| 7 | Silica | 3550 |

The above results demonstrate that under these conditions, zinc salts, zinc oxide, lithopone and silica all demonstrate the ability to regulate the heat generated by the susceptor material.

Example 8

Employing a blender, the following ingredients were blended to from an aqueous based liquid vehicle:

| Ingredient | Part by Weight |
|---|---|
| Water | 32.80 |
| Defoaming Agent (No Foam; Shamrock) | 0.75 |
| Nonylphenal Ethoxylate (40 moles) (Tergitol NP-40; Union Carbide) | 9.37 |
| Dispersent (Disperbyk 182) | 1.88 |
| Alkylolalumium Salt of Unsaturated Fatty Acid (Surfynol 104 A; Air Products) | 6.50 |
| Protective Colloid (Anti-Terra 207; Byk Chemie) | 3.70 |
| Acrylic Resin | 22.50 |
| Stryrene/Acrylic Copolymer | 22.50 |

The parts by weight of the above vehicle were blended with 2 parts of calcium carbonate (camel wite) and 20 parts of Obran-Atlantic aluminim extra brilliant No. 103 non-leafing powder. The resulting water base ink was printed onto carton stock. A sample of thin white bread was placed between two samples, printed side out and placed into a Cober Test Oven. The oven was run for 45 seconds at 70 percent power with the vent open, stirrer on and turn table running. This treatment resulted in a controlled toasting of the slice of bread.

What is claimed is:

1. A microwaveable package comprising:
(A) a dielectric substrate substantially transparent to microwave radiation; and
(B) a coating on at least a portion of at least one surface of the substrate, said coating comprising a matrix comprised of a dielectric material having dispersed therein:
(i) a sufficient amount of particles of a microwave susceptor material whereby heat is generated when the coating is exposed to microwave radiation; and
(ii) a sufficient amount of particles of a blocking agent selected from the group consisting of calcium salts, lithopone, silica and titanium dioxide whereby when said coating composition is exposed to a preselected dosage of microwave radiation, the heat generated by the susceptor material is controlled within a preselected range.

2. A microwaveable package in accordance with claim 1 wherein said matrix is composed of a material selected from the group consisting of polyacrylates, polymethacrylates, polyesters, polyester copolymers, copolyester polyurethanes, epoxy resins, polycarbonates, polyethersulfones, polyarylsulfones, polyamideimides, polyamides, poly-4'4-isopropylidene diphenylene carbonate, polyetheretherketones, imidazoles, oxazoles and thiazoles.

3. A microwaveable package in accordance with claim 2 wherein said matrix material is selected from the group consisting of acrylic polymers and copolymers.

4. A microwaveable package in accordance with claim 3 wherein said matrix material is composed of poly(methyl methacrylate) or poly(ethyl methacrylate).

5. A microwaveable package in accordance with claim 1 wherein the microwave susceptor material is selected from the group consisting of nickel, antimony, copper, molybdenum, bronze, iron, chromium, tin, zinc, silver, gold, aluminum, graphite, silicon carbides and ground metallized films.

6. A microwaveable package in accordance with claim 5 wherein said microwave susceptor material is an alloy of copper, zinc and nickel, or a leafing aluminum powder.

7. A microwaveable package in accordance with claim 1 wherein the blocking agent is selected from the group consisting of calcium carbonate, calcium sulfate, silica and titanium dioxide.

8. A microwaveable package in accordance with claim 7 wherein said blocking agent is selected from the group consisting of titanium dioxide and calcium carbonate.

9. A microwaveable package in accordance with claim 1 wherein:
A) said matrix material is selected from the group consisting of poly(methyl methacrylate) and poly(ethyl methacrylate);
B) said microwave susceptor material is selected from the group consisting of alloys of copper, zinc and nickel and leafing aluminum powder; and C) said blocking agent is selected from the group consisting of titanium dioxide and calcium carbonate.

10. A microwaveable packaging ink composition comprising a liquid carrier having incorporated therein:

(A) a dielectric polymeric material substantially transparent to microwave radiation;

(B) particles of microwave susceptor material; and (C) particles of a blocking agent selected from the group consisting of calcium salts, lithopone, silica and titanium dioxide; the microwave susceptor material and blocking agent being present in amounts whereby when a coating formed by application of said ink composition is subjected to a preselected dosage of microwave radiation, the heat generated by the coating is controlled within a preselected range.

11. A microwaveable packaging ink composition in accordance with claim 10 wherein the dielectric polymeric material is selected from the group consisting of polyacrylate, polymethyacrylates, polyesters, polyester copolymers, copolyester polyurethanes, epoxy resins, polycarbonates, polyethersulfone, polyarylsulfanes, polyamide-imides, polyimides, poly-4'4-isopropylidene diphenylene carbonate polyetheretherketones, imidazoles, oxazoles and thiazoles.

12. A microwaveable packaging ink composition in accordance with claim 11 wherein said dielectric polymeric material is selected from the group consisting of acrylic polymers and copolymers.

13. A microwaveable packaging ink composition in accordance with claim 12 wherein said dielectric polymeric material is composed of poly(methyl methacrylate) or poly(ethyl methacrylate).

14. A microwaveable packaging ink composition in accordance with claim 10 wherein the microwave susceptor material is selected from the group consisting of nickel, antimony, copper, molybdenum, bronze, iron, chromium, tin, zinc, silver, gold, aluminum, graphite, silicon carbides and ground metallized films.

15. A microwaveable packaging ink composition in accordance with claim 14 wherein said microwave susceptor material is an alloy of copper, zinc and nickel, or a leafing aluminum powder.

16. A microwaveable packaging ink composition in accordance with claim 10 wherein the blocking agent is selected from the group consisting of calcium carbonate, calcium sulfate, silica and titanium dioxide.

17. A microwaveable packaging ink composition in accordance with claim 16 wherein said blocking material is selected from the group consisting of titanium dioxide and calcium carbonate.

18. A microwaveable packaging ink composition in accordance with claim 10 wherein:

(A) said dielectric polymeric material is selected from the group consisting of poly(methyl methacrylate) and poly(ethyl methacrylate);

(B) said microwave susceptor material is selected from the group consisting of alloys of copper, zinc and nickel and leafing aluminum powder; and (c) said blocking agent is selected from the group consisting of titanium dioxide and calcium carbonate.

19. A microwaveable packaging ink composition in accordance with claim 10 wherein said liquid carrier comprises water.

20. A microwaveable packaging ink composition in accordance with claim 10 wherein said liquid carrier comprises an organic solvent.

21. A process of manufacturing a microwaveable packaging composition comprising the steps of:

(A) preparing a coating composition comprising a dielectric material having dispersed therein (i) particles of a microwave susceptor material; and (ii) particles of a blocking agent selected from the group consisting of calcium salts, lithopone, silica and titanium dioxide, and said microwave susceptor material and blocking agent being present in an amount whereby when a coating formed by application of said coating composition is subjected to a preselected dosage of microwave radiation, the heat generated by the susceptor material is controlled within a preselected range; and (B) coating said coating composition onto at least a portion of at least one surface of a dielectric substrate substantially transparent to microwave radiation.

22. A process in accordance with claim 21 wherein the coating composition is applied by gravure printing.

23. A microwaveable package comprising:

(A) a dielectric substrate substantially transparent to microwave radiation; and (B) a coating on at least a portion of at least one surface of said substrate, said coating comprising a matrix comprised of a dielectric material having dispersed therein:

(i) particles of a microwave susceptor material; and (ii) particles of a blocking agent selected from the group consisting of calcium salts, lithopone, silica and titanium dioxide, wherein the microwave susceptor material comprises between about 3 to about 80 percent by weight of the total weight of the microwave susceptor material, the dielectric material and the blocking agent; and wherein the weight ratio of said blocking agent to microwave susceptor material is 1:4 or more.

24. A microwaveable packaging ink composition comprising a liquid carrier having incorporated therein:

(A) a dielectric polymeric material substantially transparent to microwave radiation;

(B) particles of microwave susceptor material; and (C) particles of a blocking agent selected from the group consisting of calcium salts, lithopone, silica and titanium dioxide;

wherein the microwave susceptor material comprises between about 3 to about 80 percent by weight of the total weight of the dielectric polymeric material, the microwave susceptor material and the blocking agent; and wherein the weight ratio of said blocking agent to microwave susceptor material is 1:4 or more.

25. A process of manufacturing a microwaveable packaging composition comprising the steps of:

(A) preparing a coating composition comprising a dielectric material having dispersed therein (i) particles of a microwave susceptor material; and (ii) particles of a blocking agent selected from the group consisting of calcium salts, lithopone, silica and titanium dioxide, wherein the microwave susceptor material comprises between about 3 to about 80 percent by weight of the total weight of the dielectric material, the microwave susceptor material and the blocking agent; and wherein the weight ratio of said blocking agent to microwave susceptor material is 1:4 or more; and (B) coating said coating composition onto at least a portion of at least one surface of a dielectric substrate substantially transparent to microwave radiation.

* * * * *